US010950968B2

(12) United States Patent
Fair et al.

(10) Patent No.: US 10,950,968 B2
(45) Date of Patent: Mar. 16, 2021

(54) ELECTRICAL CONNECTOR WITH A CONTACT HOLDER HAVING TRANSVERSE OPENINGS TO RECEIVE FASTENERS

(71) Applicant: Eaton Intelligent Power Limited, Dublin (IE)

(72) Inventors: James Douglas Fair, Fayetteville, GA (US); Eric Cheney, Marcellus, NY (US); Vinod Manohar Shet, Bengaluru (IN)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/282,042

(22) Filed: Feb. 21, 2019

(65) Prior Publication Data

US 2020/0274284 A1 Aug. 27, 2020

(51) Int. Cl.

| | |
|---|---|
| ***H01R 13/447*** | (2006.01) |
| ***H01R 13/508*** | (2006.01) |
| ***H01R 13/436*** | (2006.01) |
| ***H01R 13/15*** | (2006.01) |
| ***H01R 13/428*** | (2006.01) |
| *H01R 13/24* | (2006.01) |
| *H01R 13/635* | (2006.01) |
| *H01R 13/187* | (2006.01) |

(Continued)

(52) U.S. Cl.

CPC ..... *H01R 13/447* (2013.01); *H01R 13/15* (2013.01); *H01R 13/428* (2013.01); *H01R 13/4367* (2013.01); *H01R 13/508* (2013.01); *H01R 4/30* (2013.01); *H01R 4/36* (2013.01); *H01R 4/48* (2013.01); *H01R 9/18* (2013.01); *H01R 9/24* (2013.01); *H01R 12/58* (2013.01); *H01R 12/7047* (2013.01); *H01R 13/17* (2013.01); *H01R 13/187* (2013.01); *H01R 13/2421* (2013.01); *H01R 13/2471* (2013.01); *H01R 13/4532* (2013.01); *H01R 13/4538* (2013.01); *H01R 13/512* (2013.01); *H01R 13/5208* (2013.01); *H01R 13/5213* (2013.01); *H01R 13/53* (2013.01); *H01R 13/595* (2013.01); *H01R 13/635* (2013.01)

(58) Field of Classification Search

CPC ..... H01R 4/36; H01R 13/2421; H01R 9/24; H01R 13/5208; H01R 13/53; H01R 9/18; H01R 12/58; H01R 12/7047; H01R 13/447; H01R 13/4532; H01R 13/512; H01R 13/5213; H01R 4/30; H01R 13/187; H01R 13/2471; H01R 13/595; H01R 13/635; H01R 4/48

USPC ..... 439/143, 700, 482, 524, 814

See application file for complete search history.

(56) References Cited

U.S. PATENT DOCUMENTS 4,106,834 A * 8/1978 Horowitz ..... H01R 13/533 439/142

5,564,934 A * 10/1996 Shimotsu ..... G02B 6/3849 439/139

(Continued)

*Primary Examiner* — Abdullah A Riyami
*Assistant Examiner* — Justin M Kratt
(74) *Attorney, Agent, or Firm* — Stinson LLP

(57) ABSTRACT

A receptacle and/or a plug of an electrical connector includes a proximal body portion defining transverse alignment slots extending through a side of the proximal body portion for contacts. A plug of an electrical connector includes a safety disk. The safety disk includes a hollow stem having at least one prong slidably inserted through a groove and captured within a central axial passage of a housing.

20 Claims, 14 Drawing Sheets

(51) Int. Cl.

| | |
|---|---|
| *H01R 12/70* | (2011.01) |
| *H01R 4/48* | (2006.01) |
| *H01R 13/52* | (2006.01) |
| *H01R 13/595* | (2006.01) |
| *H01R 13/17* | (2006.01) |
| *H01R 9/24* | (2006.01) |
| *H01R 4/30* | (2006.01) |
| *H01R 13/53* | (2006.01) |
| *H01R 13/512* | (2006.01) |
| *H01R 13/453* | (2006.01) |
| *H01R 9/18* | (2006.01) |
| *H01R 4/36* | (2006.01) |
| *H01R 12/58* | (2011.01) |

(56) References Cited

U.S. PATENT DOCUMENTS

| | | | | |
|---|---|---|---|---|
| 7,789,718 | B2 * | 9/2010 | Desard | H01R 9/2416<br>439/796 |
| 9,512,921 | B2 | 12/2016 | Zagroun et al. | |
| 2015/0280344 | A1 * | 10/2015 | Henry | G01R 1/06738<br>439/700 |

* cited by examiner

ELECTRICAL CONNECTOR WITH A CONTACT HOLDER HAVING TRANSVERSE OPENINGS TO RECEIVE FASTENERS

FIELD OF THE DISCLOSURE

The present disclosure generally relates to an electrical connector, and more particularly, to a receptacle for the electrical connector, and a plug for the electrical connector.

BACKGROUND OF THE DISCLOSURE

An electrical connector may be a switch-rated electrical connector in which it can be used as a switch to de-energize electrical devices and equipment, as well as an electrical connector. One such electrical connector includes a receptacle with a rotatable safety disk covering the electrical contacts in a closed position, and plug with electrical pins that are insertable into the safety disk to rotate the safety disk to an open position. In the open position, the plug is insertable axially into the receptacle to electrically engage the electrical contacts in the receptacle.

SUMMARY OF THE DISCLOSURE

In one aspect, a receptacle for an electrical connector generally comprises a receptacle housing having opposite distal and proximal ends and an axis extending between the distal and proximal ends. The distal end defines a receptacle opening through which a mateable plug is insertable. A contact holder is received in the housing and having distal and proximal ends and an axis extending between the distal and proximal ends. The contact holder includes a holder body having opposite distal and proximal body portions, wherein the proximal body portion defines transverse alignment slots extending through a side of the proximal body portion. A plurality of contacts is supported by the contact holder. Each contact includes a wire terminal, a compressible pin extending distally outward from the wire terminal, and a terminal fastener extending transversely from the wire terminal. The terminal fasteners are received and retained in the transverse alignment slots.

In another aspect, a plug for an electrical connector generally comprises a housing having opposite distal and proximal ends and an axis extending between the distal and proximal ends. The proximal end is receivable in a receptacle to mateably connect the plug to the receptacle. A contact holder is received in the housing and having distal and proximal ends and an axis extending between the distal and proximal ends. The contact holder includes a holder body defining transverse alignment slots extending through a side of the holder body. A plurality of contacts are received in respective axial passages. Each contact includes a wire terminal, a pin extending proximally outward from the wire terminal, and a terminal fastener extending transversely from the wire terminal. The terminal fasteners are received and retained in the transverse alignment slots.

In yet another embodiment, a receptacle for an electrical connector generally comprises a housing having opposite distal and proximal ends and an axis extending between the distal and proximal ends. The distal end defines a receptacle opening through which a mateable plug is insertable. A contact holder is received in the housing and has distal and proximal ends and an axis extending between the distal and proximal end. The contact holder includes a holder body having a distal body portion. The distal body portion defines a plurality of axial passages including a central axial passage. The distal body portion defines at least one groove extending along the central axial passage. A safety disk is rotatably secured to the holder body. The safety disk defines a plurality of axial openings. The safety disk is selectively rotatable relative to the housing and the holder body between an open position, in which the axial disk openings are aligned with respective axial passages of the holder body, and a closed position, in which the axial disk openings are misaligned with the axial passages and the safety disk at least partially covers the axial passages. The safety disk includes a hollow stem including at least one prong slidably inserted through the groove and captured within the central axial passage.

DETAILED DESCRIPTION OF THE DISCLOSURE

Figure 1:
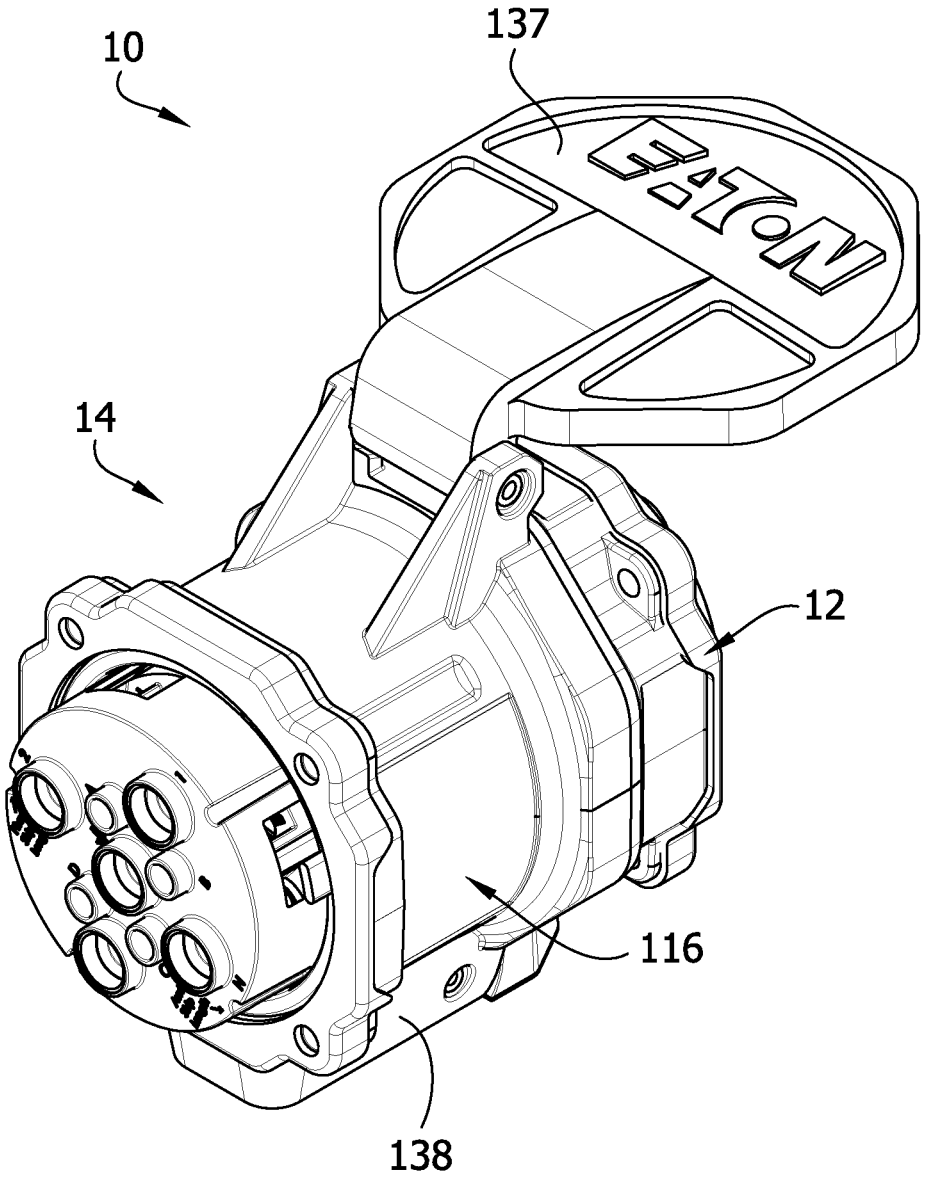
FIG. 1 is a perspective of an electrical connector constructed according to the teachings of the present disclosure.
Figure 2:
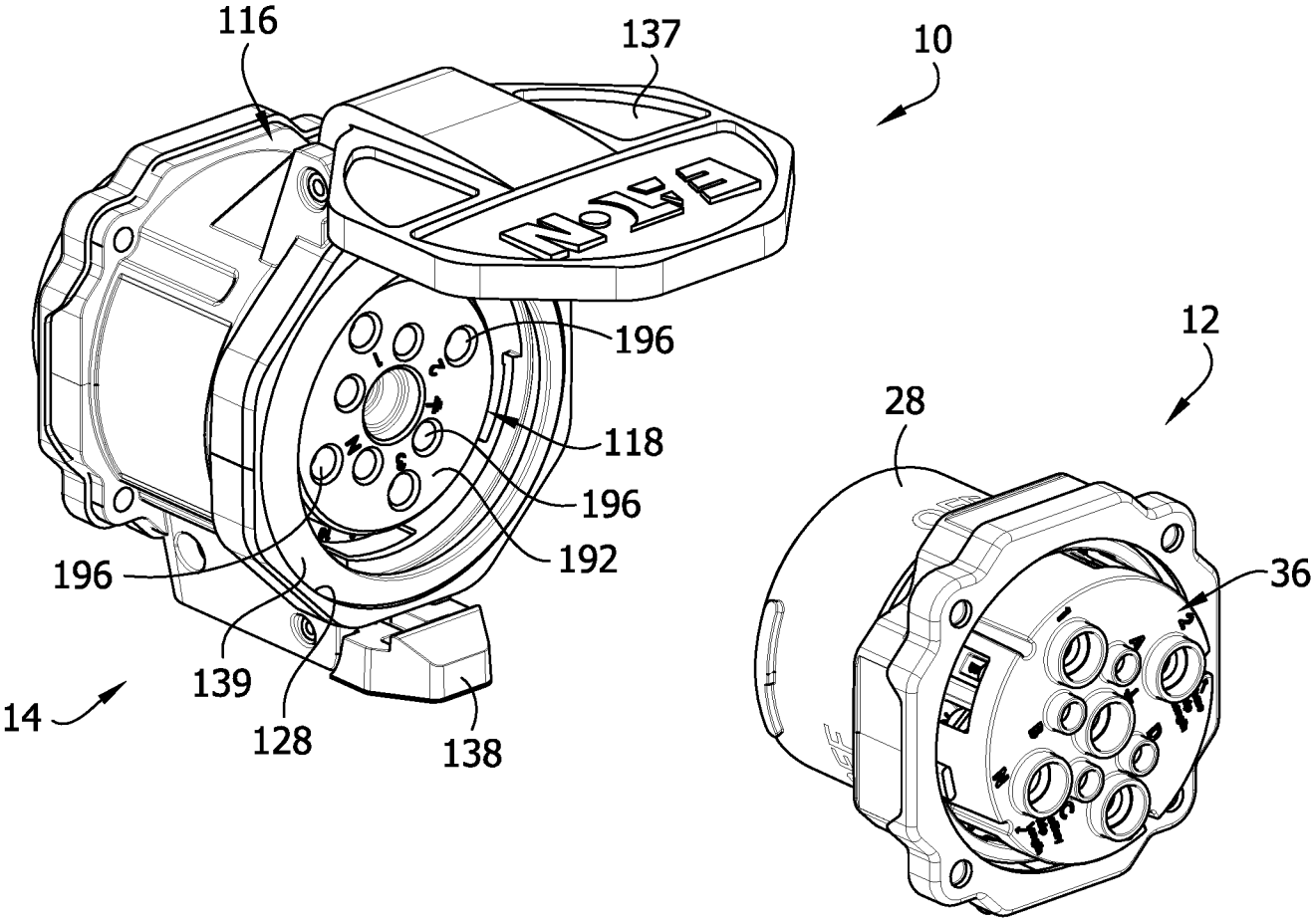
FIG. 2 is an exploded view of the electrical connector of FIG. 1, showing a plug and a receptacle unconnected to one another.

Referring to FIGS. 1 and 2, an electrical connector constructed according to the teachings of the present disclosure is generally indicated at reference numeral 10. The electrical connector 10 includes a plug, generally indicated at 12, and a receptacle, generally indicated at 14, configured to mateably receive and electrically connect to the plug, as shown in FIG. 1. The plug 12 is typically electrically connected to an electrical cord of an electrical device, and the receptacle 14 is typically electrically connected to the power supply, although these may be reversed. As described herein, terms "proximal" and "distal" are used for non-limiting purposes to describe relative locations of the components of the plug 12 and the receptacle 14 with the point of reference being the flow of power from the power supply through the connector 10 when the receptacle is electrically connected to the power supply and the plug is electrical connected to the electrical device when the connector is separated. Accordingly, the receptacle 14 is generally located proximal of the plug 12, as used herein. The electrical connector may be constructed as a switch-rated connector, according to UL 2682, for example.

Plug

Figure 4:
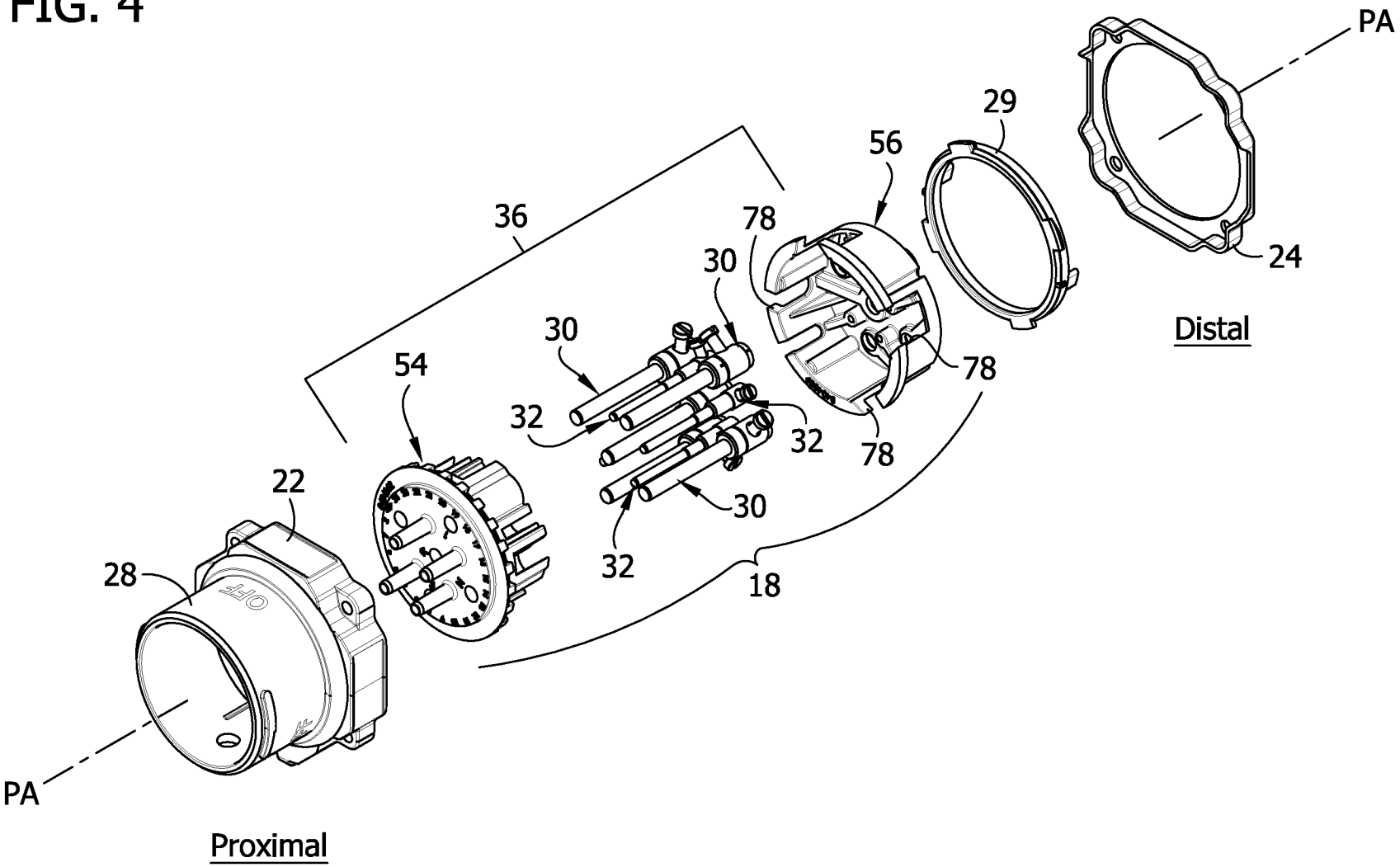
FIG. 4 is an exploded view of the plug.

Referring to FIG. 4, in general the plug 12 includes a plug housing, generally indicated at 16, in which a plug contact assembly, generally indicated at 18, is received. The plug housing 16 has a plug axis PA extending between distal and proximal ends of the housing. In the drawings, the plug housing 16 includes a proximal end portion 22, and a gasket 24 secured to the distal end portion. A distal end portion (not shown) may be secured to the proximal end portion 22 and the gasket 24 such that the gasket is disposed axially between the proximal and distal end portions. The proximal end portion 22 of the plug housing 16 has a generally cylindrical mating segment 28 that is sized and shaped to be received in a mating distal end of the receptacle 14, as described in more detail below. The plug housing 16 may be formed from plastic or other material. The plug contact assembly 18 is secured in the plug housing 16 by a locking ring 29, or in other ways.

Figure 3:
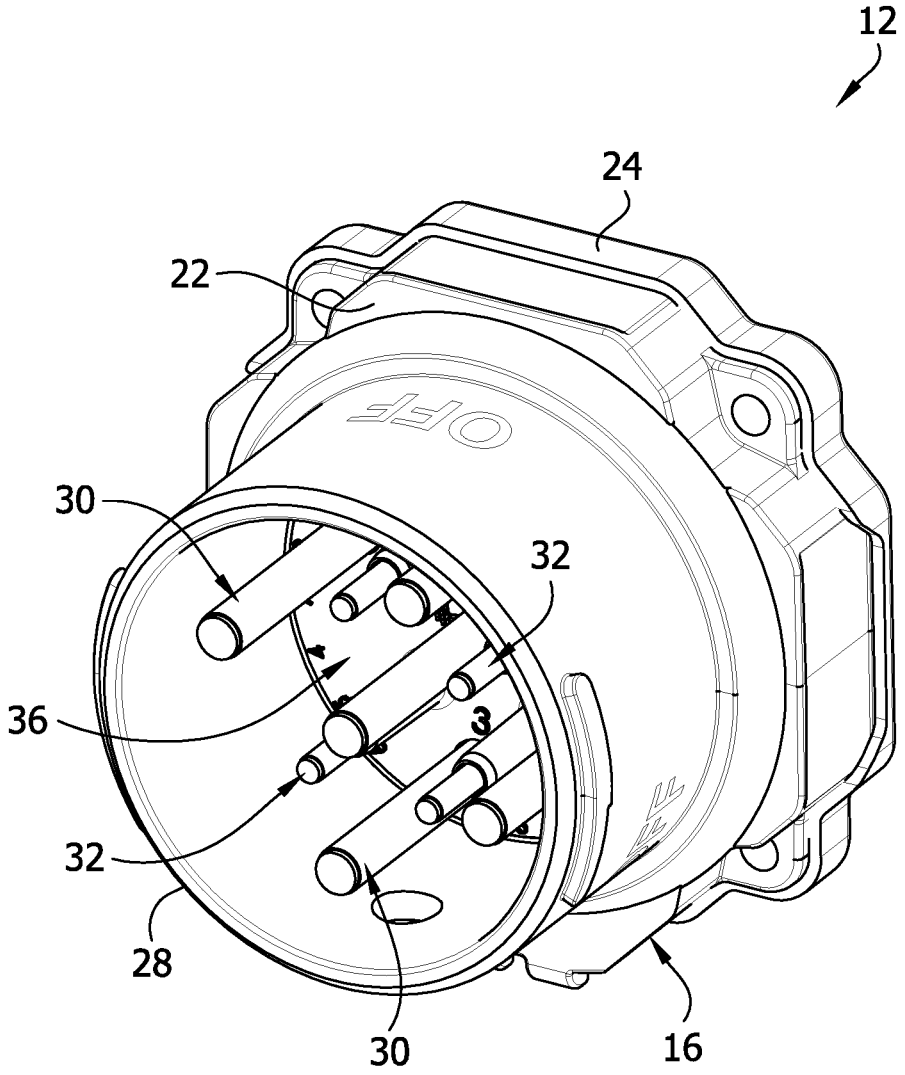
FIG. 3 is a perspective of the plug.
Figure 5:
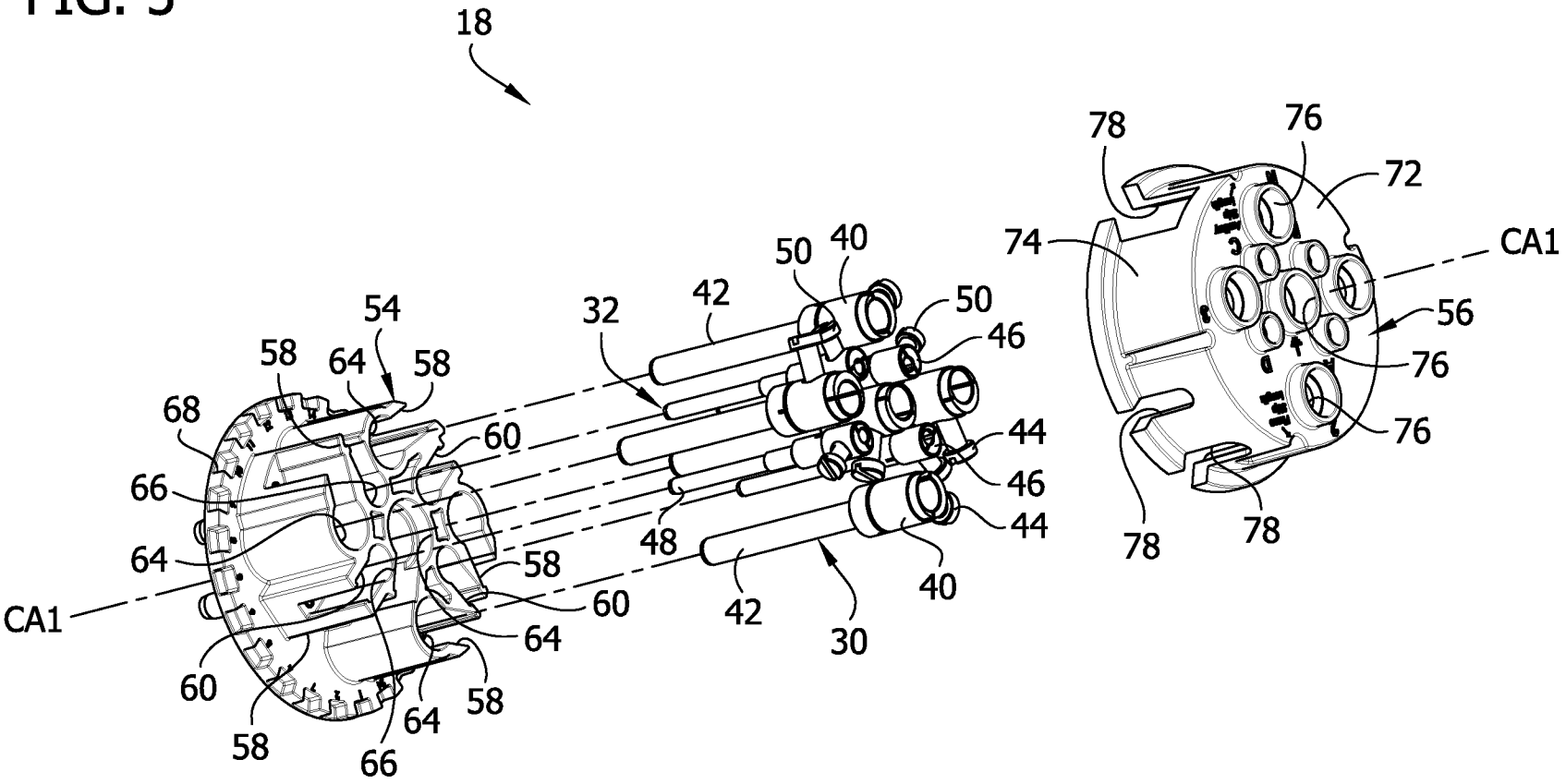
FIG. 5 is an exploded view of a plug contact assembly of the plug.

Referring to FIGS. 3-5, the plug contact assembly 18 includes a plurality of contacts (e.g., primary contacts 30 and auxiliary contacts 32), and a contact holder 36 supporting the plurality of contacts. The illustrated plug contact assembly 18 includes both primary and auxiliary contacts 30, 32, although in other embodiments the plug assembly may include different combinations of primary contacts and auxiliary contacts. As shown best in FIG. 5, each of the primary contacts 30 includes a primary wire terminal 40 defining an axial opening for receiving a primary wire (not shown) therein, a primary pin 42 extending proximally from the primary wire terminal, and a terminal fastener 44 (e.g., set screw) extending generally transversely outward from the primary wire terminal for use in securing the primary electrical wire in the axial opening of the terminal. Together, the primary wire terminal 40 and the terminal fastener 44 define a primary wire connector. The primary pin 42 may be non-compressible lengthwise. Similarly, each of the auxiliary contacts 32 includes an auxiliary wire terminal 46 defining an axial opening for receiving an auxiliary wire (not shown) therein, an auxiliary pin 48 extending proximally from the auxiliary wire terminal, and a terminal fastener 50 (e.g., set screw) extending generally transversely outward from the auxiliary wire terminal for use in securing the auxiliary wire in the axial opening of the terminal. The auxiliary pin 48 may be generally rigid and non-compressible. The contacts 30, 32 may be of other configurations without necessary departing from the scope of the present disclosure.

Figure 6:
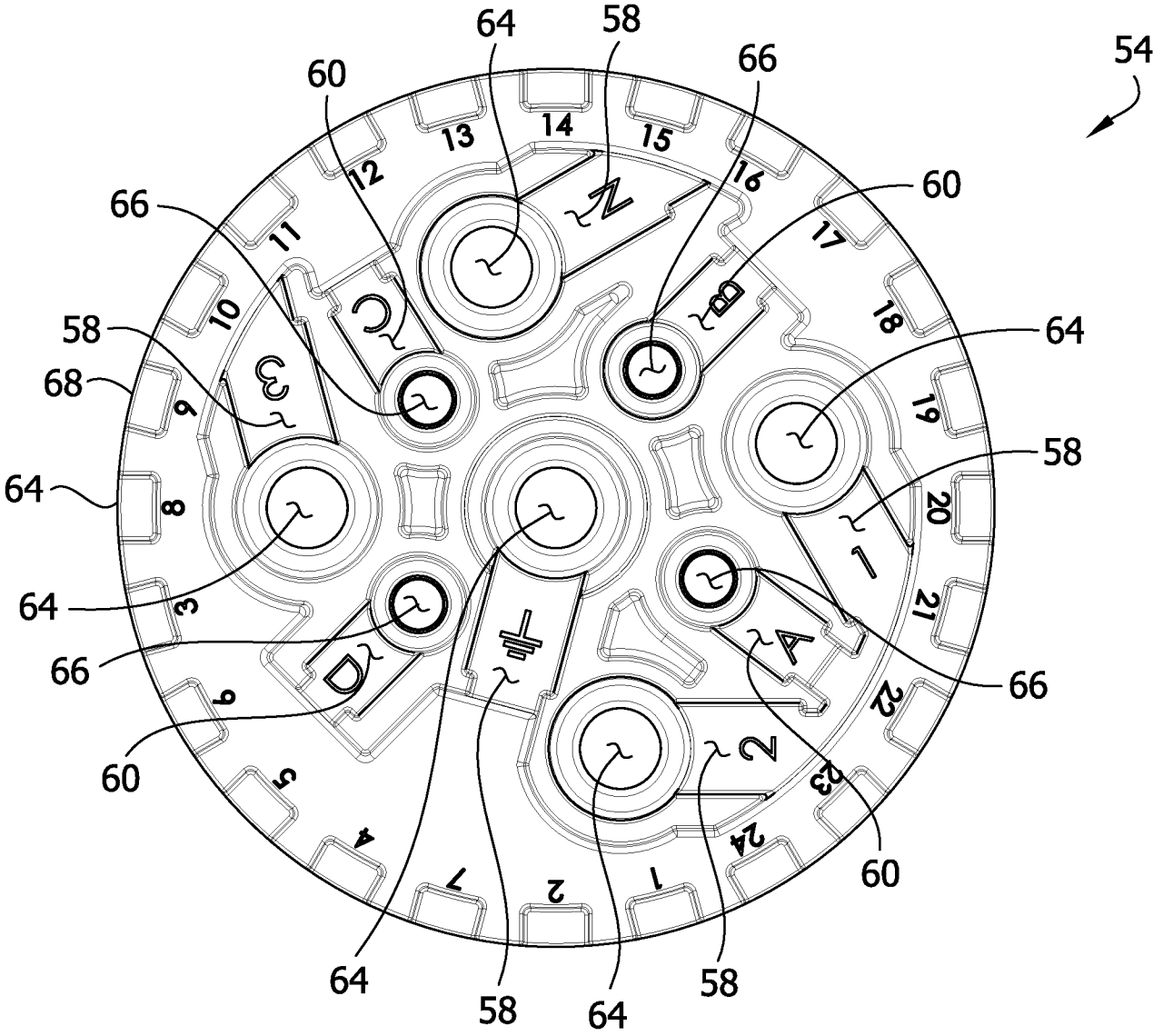
FIG. 6 is a distal end view of a holder body of a plug contact holder of the plug contact assembly.

The plug contact holder 36 is received in the plug housing 16. The contact holder 36 has distal and proximal ends and a contact holder axis CA1 extending between the distal and proximal ends. The contact holder 36 includes a holder body, generally indicated 54, and a holder cap 56 secured to the holder body. As shown in FIGS. 5 and 6, the holder body 54 defines alignment slots (e.g., primary alignment slots 58 and auxiliary alignment slots 60) extending transversely through a side wall of the holder body and the distal end of the holder body. In other embodiments, the plug 12 may include only the primary alignment slots 58 or only the auxiliary alignment slots 60. The primary and auxiliary terminal fasteners 44, 50 are received in the respective primary and auxiliary alignment slots 58, 60. The alignment slots 58, 60 guide the plug contacts 30, 32, and more particularly the terminal fasteners 44, 50, into a desired rotational position relative to the holder body 54 and retain the desired rotational position of the plug contacts to facilitate assembly of the plug. The respective pins 42, 48 extend outward (e.g., proximally outward) relative to the holder body 54.

Referring still to FIGS. 5 and 6, the holder body 54 also defines axial passages (e.g., primary axial passages 64 and auxiliary axial passages 66) having open proximal and distal ends (i.e., the axial passages extending through proximal and distal ends of the holder body). The alignments slots 58, 60 extend generally transversely from the respective axial passages 64, 66. The illustrated plug contact assembly 18 includes both primary and auxiliary axial passages 64, 66, although in other embodiments the plug assembly may include only the primary axial passages. The primary wire terminals 40 are received in the primary axial passages 64, and the primary pins 42 extend proximally outward relative to the primary axial passages. The auxiliary wire terminals 46 are received in the auxiliary axial passages 66, and the auxiliary pins 48 extend proximally outward relative to the auxiliary axial passages. In the illustrated embodiment, the holder body 54 also includes a face plate 68 at the proximal end of the holder body 54 through which the pins 42, 48 extend proximally into the cylindrical mating segment 28 of the plug housing 16. The illustrated face plate 68 has a generally disk shape, although it may be of other shapes. The face plate 68 and the holder body 54 may be integrally formed as a one-piece component, as illustrated, or the components may be formed separately and secured to one another, such as by a mechanical fastener.

Referring to FIG. 5, the holder cap 56 has a distal face 72, and skirt 74 extending proximally from the distal face. The holder body 54 is received in the holder cap 56 such that the skirt 74 surrounds the holder body. Wire openings 76 in the distal face 72 are aligned with the axial passages 64, 66 and the wire terminals 40, 46 to allow respective wires to be inserted through the wire openings and into the corresponding wire terminals. Transverse openings 78 in the skirt 74 are aligned with corresponding alignment slots 58, 60 and terminal fasteners 44, 50 to allow access to the terminal fasteners using a tool (e.g., a screwdriver) to secure the wires within the respective wire terminals 40, 46. As can be understood, the alignment slots 58, 60 both position and retain the contacts 30, 32 in the proper orientation and additionally allow access to the terminal fasteners 44, 40 with a tool to facilitate wiring of the plug 12.

Receptacle

Referring to FIGS. 1 and 2, in general the receptacle 14 includes a receptacle housing, generally indicate at 116, in which a receptacle contact assembly, generally indicated at 118, is received and retained. The receptacle housing 116 has a receptacle axis RA (FIG. 7) extending between distal and proximal ends of the housing. In the drawings, referring to FIG. 7, the receptacle housing 116 includes a distal end portion 122, and a gasket 124 secured to the distal end portion adjacent a proximal end of the distal end portion. A proximal end portion (not shown) may be secured to the distal end portion 122 and the gasket 124. The distal end portion 122 of the receptacle housing 116 has a generally cylindrical mating segment 128 that is sized and shaped to receive the mating segment 28 of the plug 12 therein, as described in more detail below. The receptacle contact assembly 118 is secured in the receptacle housing 116 by a locking ring 129, or in other ways. The receptacle housing 16 may be formed from plastic or other material. A lid 137 is pivotably secured to the housing 116 for opening and closing the mating segment 128 of the receptacle 14. A toggle latch 138 is pivotably secured to the housing 116 to releasably attach the receptacle 14 to the plug 12 when the plug is mated with the receptacle. The toggle latch also secures the lid 137 when the plug 12 is not inserted into the receptacle 14. A gasket 139 is received in the mating segment 128 to form a liquid-tight seal with the plug 12 when mated with the receptacle 14. The gasket 139 also seals against the lid 137 when the plug 12 is not inserted into the receptacle 14.

Figure 7:
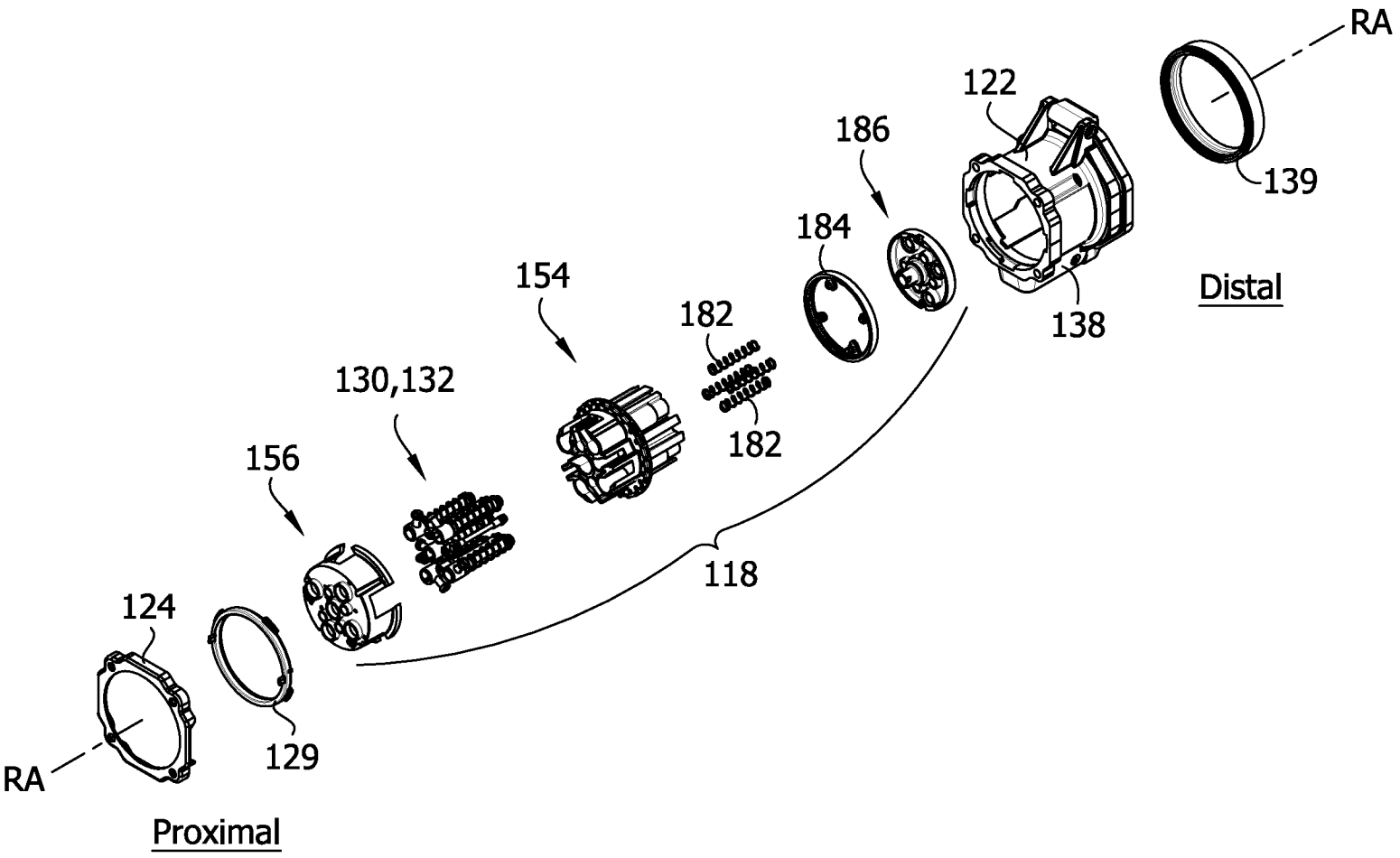
FIG. 7 is an exploded view of a receptacle.
Figure 8:
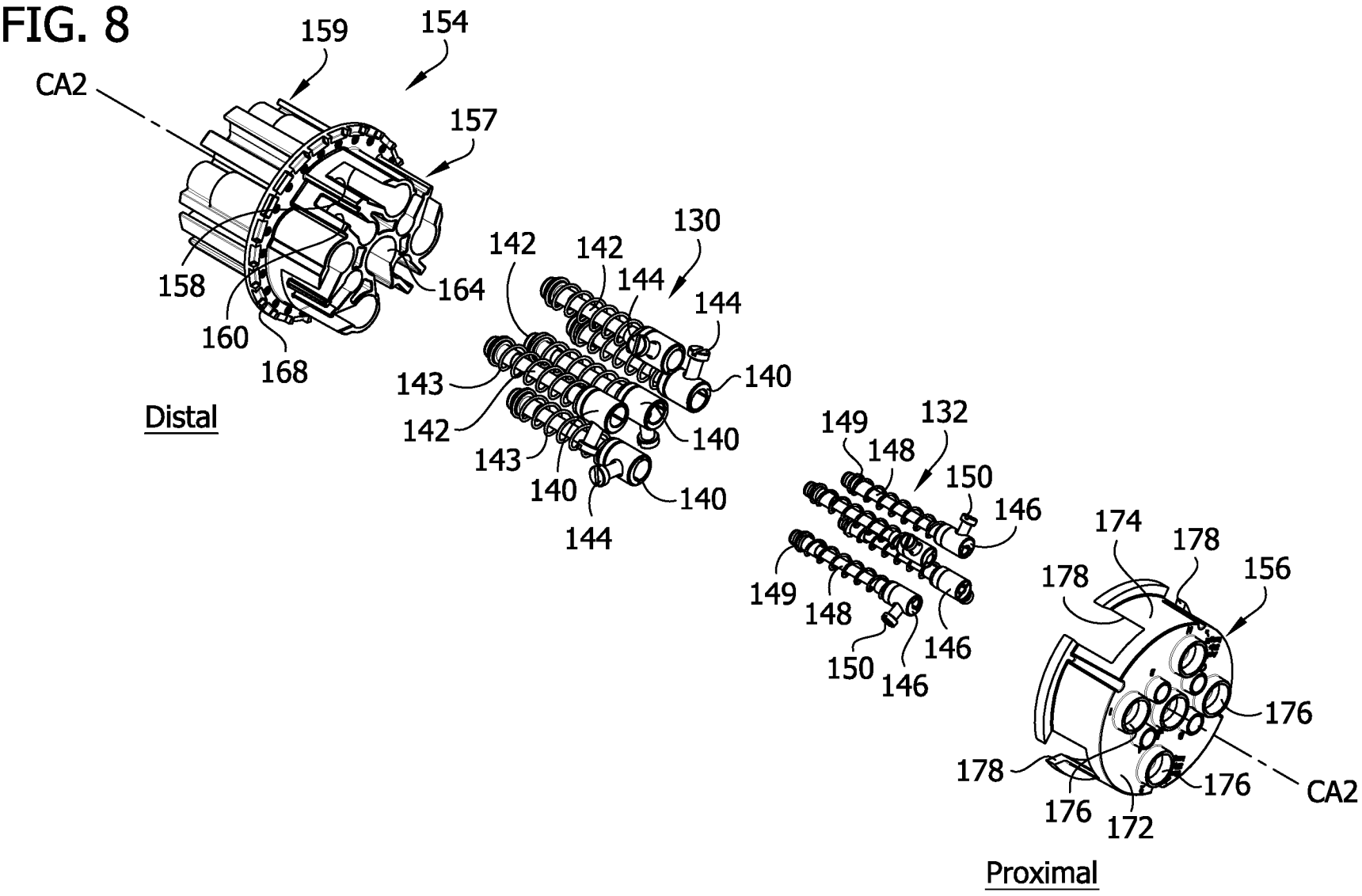
FIG. 8 is an exploded view of a proximal portion of the receptacle contact assembly of the receptacle.
Figure 9:
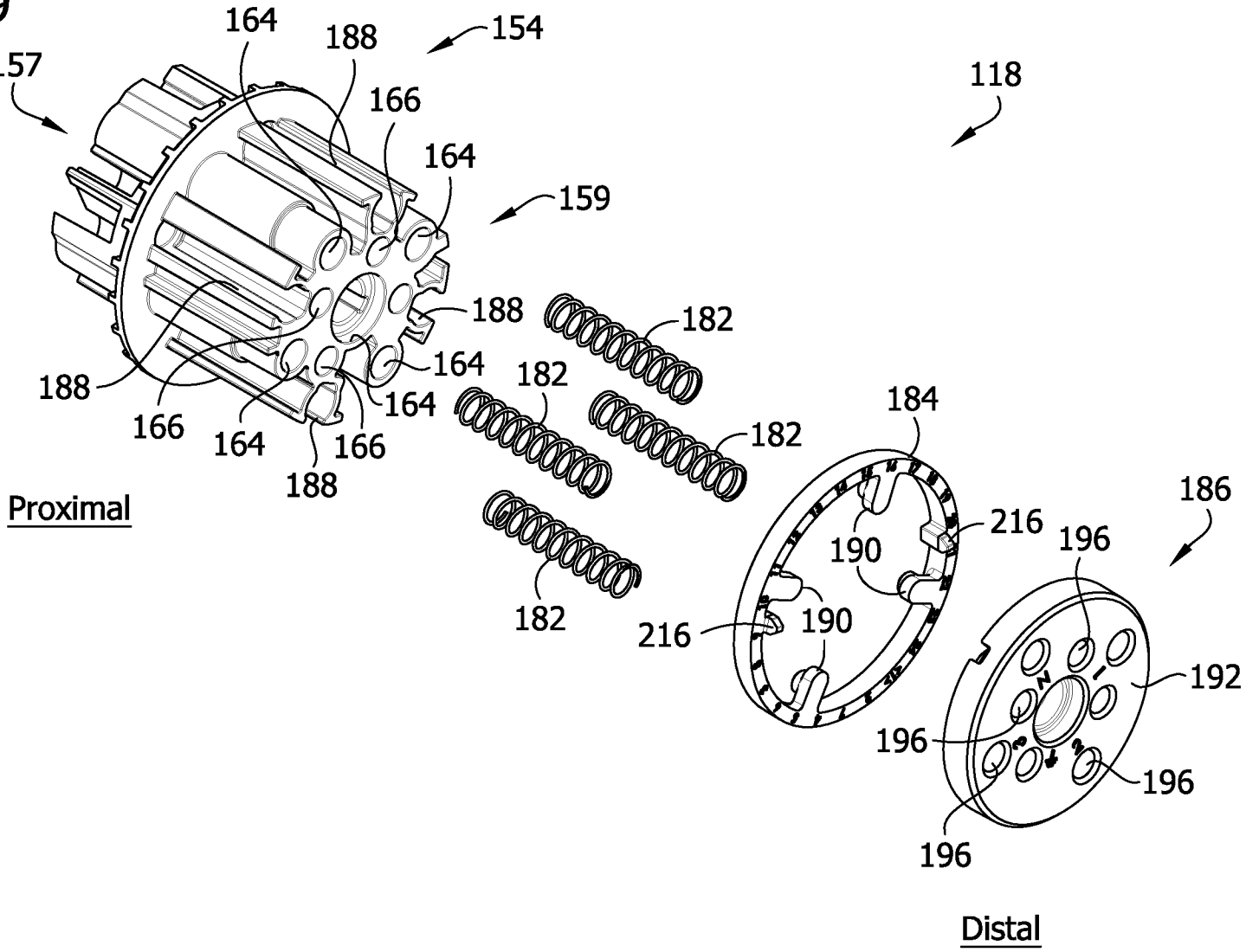
FIG. 9 is an exploded view of a distal portion of the receptacle contact assembly of the receptacle.

Referring to FIGS. 7-9, the receptacle contact assembly 118 includes a plurality of receptacle contacts (e.g., primary contacts 130 and auxiliary contacts 132), and a receptacle contact holder supporting the plurality of receptacle contacts. The illustrated receptacle contact assembly 118 includes both primary and auxiliary contacts 130, 132, although in other embodiments the receptacle assembly may include different combinations of the primary contacts and the auxiliary contacts. Each of the primary contacts 130 includes a primary wire terminal 140 defining an axial opening for receiving a primary wire (not shown) therein, a primary pin 142 extending distally from the primary wire terminal, and a terminal fastener 144 (e.g., set screw) extending generally transversely outward from the wire terminal for use in securing a primary electrical wire in the wire terminal. Together, the primary wire terminal 140 and the screw 144 define a primary wire connector. The primary pin 142 may be elastically compressible axially, and a compression spring 143 may surround the primary pin to facilitate rebounding of the primary pin. Similarly, each of the auxiliary contacts 132 includes an auxiliary wire terminal 146 defining an axial opening for receiving an auxiliary wire (not shown) therein, and an auxiliary pin 148 extending distally from the auxiliary wire holder, and a terminal fastener 150 (e.g., screw) extending generally transversely outward from the wire terminal for use in securing the auxiliary wire in the axial opening. The auxiliary pin 142 may be elastically compressible axially, and a compression spring 151 may surround the auxiliary pin to facilitate rebounding of the auxiliary pin. The contacts 130, 132 may be of other configurations without necessary departing from the scope of the present disclosure.

Referring to FIGS. 8 and 9, the receptacle contact holder has distal and proximal ends and a contact holder axis CA2 extending between the distal and proximal ends. The contact holder includes a holder body, generally indicated 154, and a holder cap 156 secured to the holder body. The holder body 154 includes a proximal body portion, generally indicated at 157, a distal body portion, generally indicated at 159, and an intermediate base plate 168 having a disk-shape disposed between the proximal and distal body portions. The holder body 154 may be integrally formed as a one-piece component, as illustrated, or the components may be formed separately and secured to one another, such as by a mechanical fastener.

Figure 10:
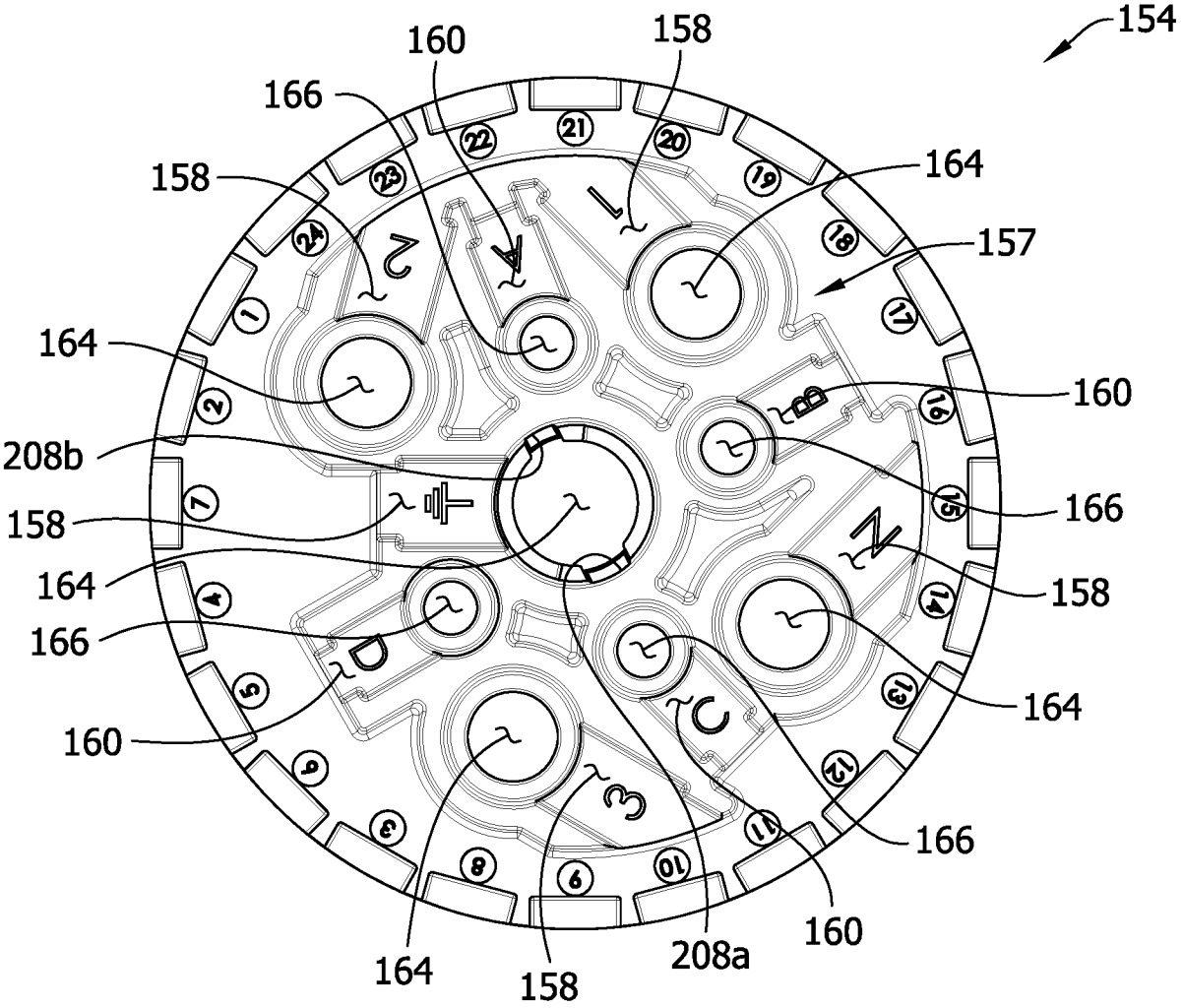
FIG. 10 is a proximal end view of a holder body of a receptacle contact holder of the receptacle contact assembly.
Figure 11:
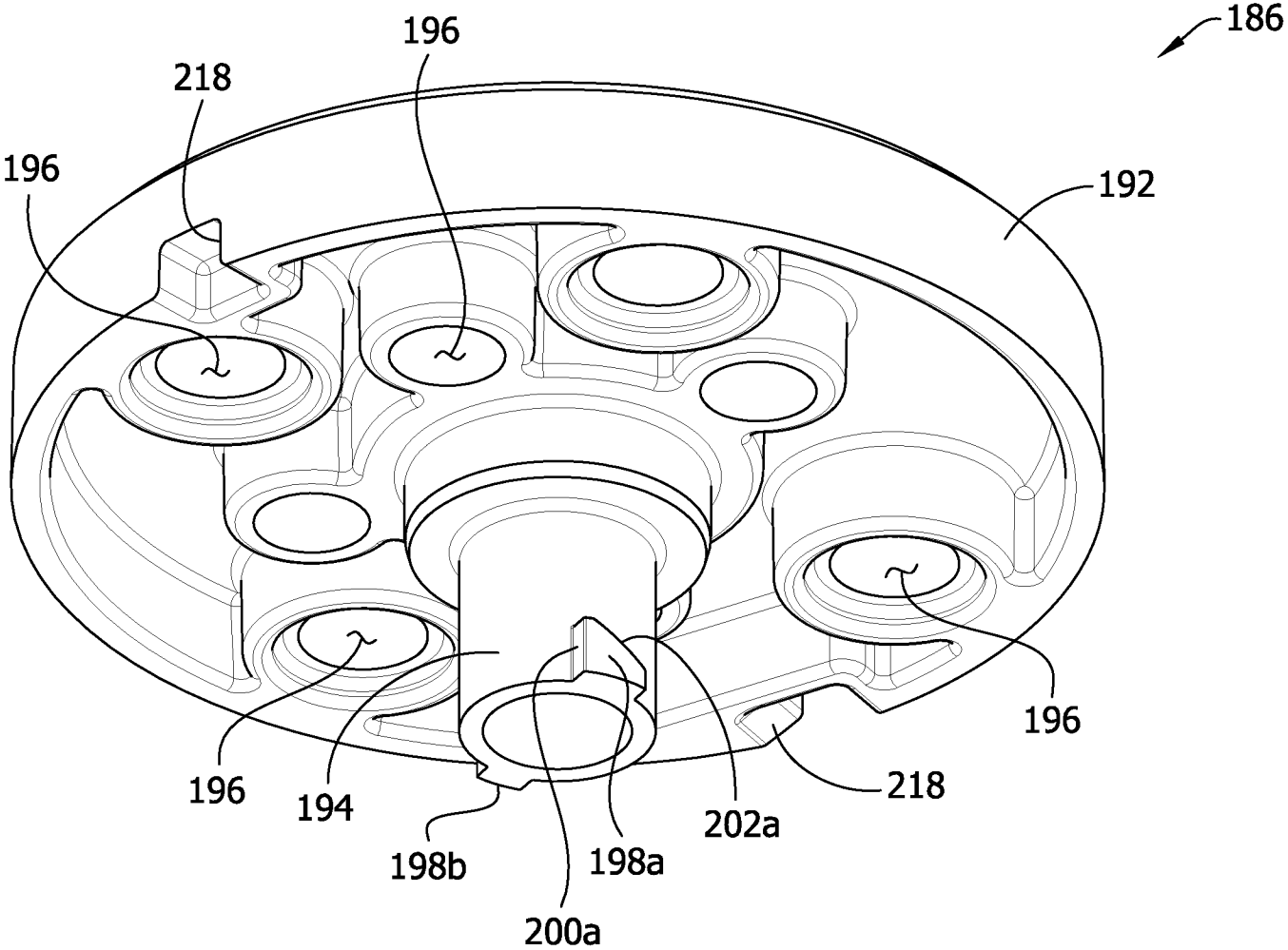
FIG. 11 is a proximal end perspective of a safety disk of the receptacle contact assembly.
Figure 12:
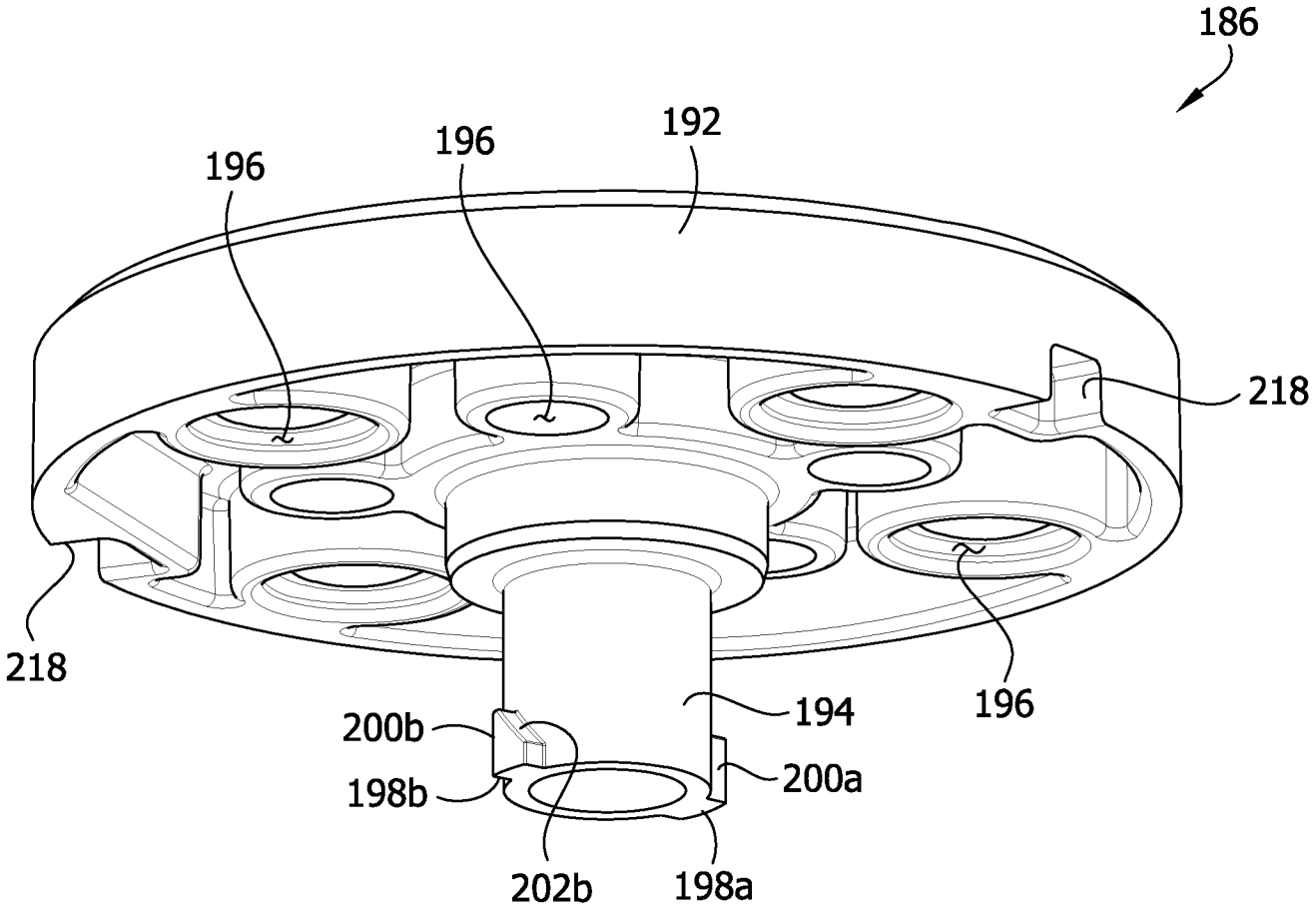
FIG. 12 is similar to FIG. 11, except in a different angular orientation.

Referring to FIGS. 8 and 10, the proximal body portion 157 defines transverse alignment slots (e.g., primary alignment slots 158 and auxiliary alignment slots 160) extending transversely through a side wall of the proximal portion 157. In other embodiments, the holder body 154 may include only the primary alignment slots 158. The primary and auxiliary terminal fasteners 144, 150 are received in the respective primary and auxiliary alignment slots 158, 160. The alignment slots 158, 160 guide the receptacle contacts 130, 132, and more particularly the terminal fasteners 144, 150, into a desired rotational position relative to the holder body 154 and retain the desired rotational position of the receptacle contacts to facilitate assembly of the receptacle. The respective pins 142, 148 extend outward (e.g., distally outward) relative to the proximal portion 157 of the holder body 154.

Referring to FIGS. 9 and 10, the holder body 154 also defines axial passages (e.g., primary axial passages 164 and auxiliary axial passages 166) having open proximal and distal ends (i.e., the axial passages extending through the proximal and distal portions 157, 159 of the holder body 154 and the intermediate base plate 168). The alignments slots 158, 160 extend generally transversely from the respective axial passages 164, 166 at the proximal body portion 157 of the holder body 154. The illustrated receptacle contact assembly 118 includes both primary and auxiliary axial passages 160, 162, although in other embodiments the receptacle contact assembly may include only the primary axial passages. The primary wire terminals 140 are received in the primary axial passages 160 in the proximal body portion 157, and the primary pins 142 extend distally within the axial passages into the distal body portion 159. Likewise, the auxiliary wire terminals 140 are received in the auxiliary axial passages 160 in the proximal body portion 157, and the auxiliary pins 148 extend distally within the auxiliary axial passages into the distal body portion 159.

Referring to FIG. 8, the holder cap 156 has a proximal face 172 and a skirt 174 extending distally from the proximal face. The proximal body portion 157 of the holder body 154 is received in the holder cap 156 such that the skirt 174 surrounds the proximal body portion. Wire openings 176 in the proximal face 172 are aligned with the axial passages 164, 166 and the wire terminals 140, 146 to allow respective wires to be inserted through the wire openings and into the corresponding wire terminals. Transverse openings 178 in the skirt 174 are aligned with respective alignment slots 158, 160 and terminal fasteners 144, 150 to allow access to the terminal fasteners using a tool (e.g., a screwdriver) to secure the wires within the respective wire terminals. As can be understood, the alignment slots 158, 160 both position and retain the contacts 130, 132 in the proper orientation and additionally allow access to the terminal fasteners 144, 140 with a tool to facilitate wiring of the receptacle 14.

Referring to FIG. 9, the receptacle 14 also includes compression springs 182, a compression ring 184, and a contact cover or rotatable safety disk, generally indicated at 186. The compression springs 182 are received in individual spring holders 188 defined by the distal body portion 159 and extending axially adjacent the axial passages 164, 166. The compression ring 184 includes spring contacts 190 which overlay and engage the distal ends of the compression springs 182. The compression ring 184 is axially movable along the distal body portion 159 to compression the compression springs 182 when the proximal mating segment 28 of the plug 12 is inserted into the receptacle 14. In particular, the proximal mating segment 28 engages the compression ring 184 and compresses the springs 182 as the proximal mating segment is inserted axially into the mating segment 128 of the receptacle 14.

Referring to FIGS. 11-14, the safety disk 186 is rotatably secured to the distal body portion 159 and retains the compression ring 184 on the distal body portion, which in turn, captures the compression springs 182 in the spring holders 188. The safety disk 186 includes a face plate 192 at its distal end, and a hollow stem 194 extending proximally from the face plate and rotatably captured in the central axial passage 164 (e.g., ground contact axial passage) in the distal body portion 159 of the holder body 154. The face plate 192 defines axial openings 196 (including a central axial opening for ground contact) for receiving the pins 142, 148 (e.g., primary and secondary pins) of the plug 12. The stem 194 includes a stem body and prongs (e.g., first and second prongs, 198*a*, 198*b*) extending radially outward from the stem body. In the illustrated embodiment, the prongs 198*a*, 198*b* are diametrically opposite one another on the stem body. Each prong 198*a*, 198*b* has a substantially straight, axial side wall, 200*a*, 200*b*, respectively, a sloping side wall, 202*a*, 202*b*, respectively, and a maximum width extending between the axial and sloping side walls adjacent the proximal end of the prong. In the illustrated embodiment, the first prong 198*a* has a maximum width greater than the second prong 198*b*. The first and second prongs 198*a*, 198*b* are insertable into respective first and second grooves 208*a*, 208*b* of the central axial passage 164 defined by the distal body portion 159. The second groove 208*b* has a width slightly greater than the width of the second prong 198*b* and less than the width of the first prong 198*a*. The first and second prongs 198*a*, 198*b* are captured between first and second ramps 210*a*, 210*b* adjacent proximal ends of the respective first and second grooves 208*a*, 208*b*, and are rotatable along first and second tracks 212*a*, 212*b* within the holder body 154. The prongs 198*a*, 198*b*, and the safety disk 186 in general, are rotatable between the first and second ramps 210*a*, 210*b* such that the ramps limit the angular amount by which the safety disk is rotatable relative to the holder body 154.

Figure 13:
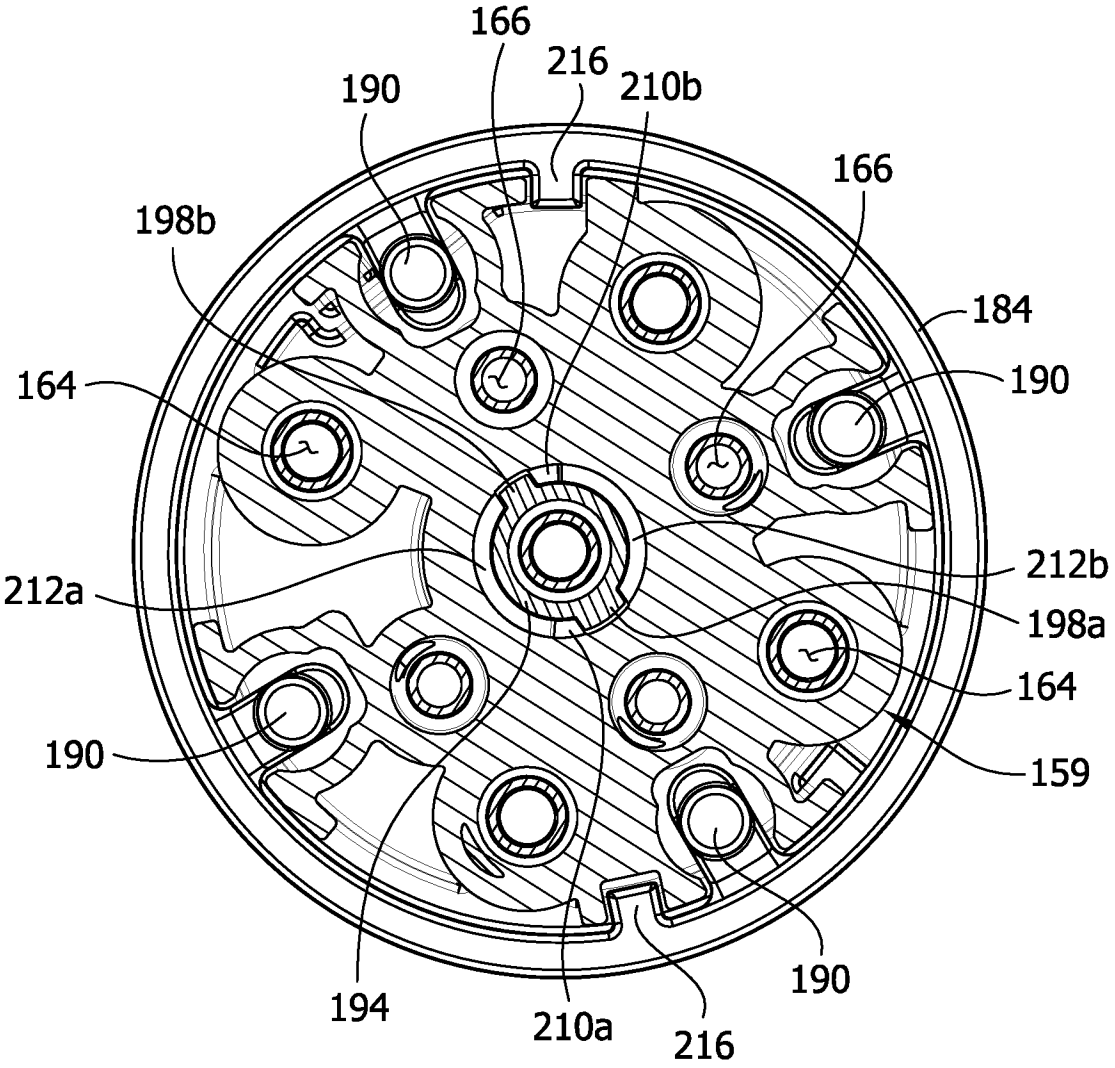
FIG. 13 is a cross section of the receptacle contact holder, showing prongs of the safety disk received in corresponding grooves of the holder body.
Figure 14:
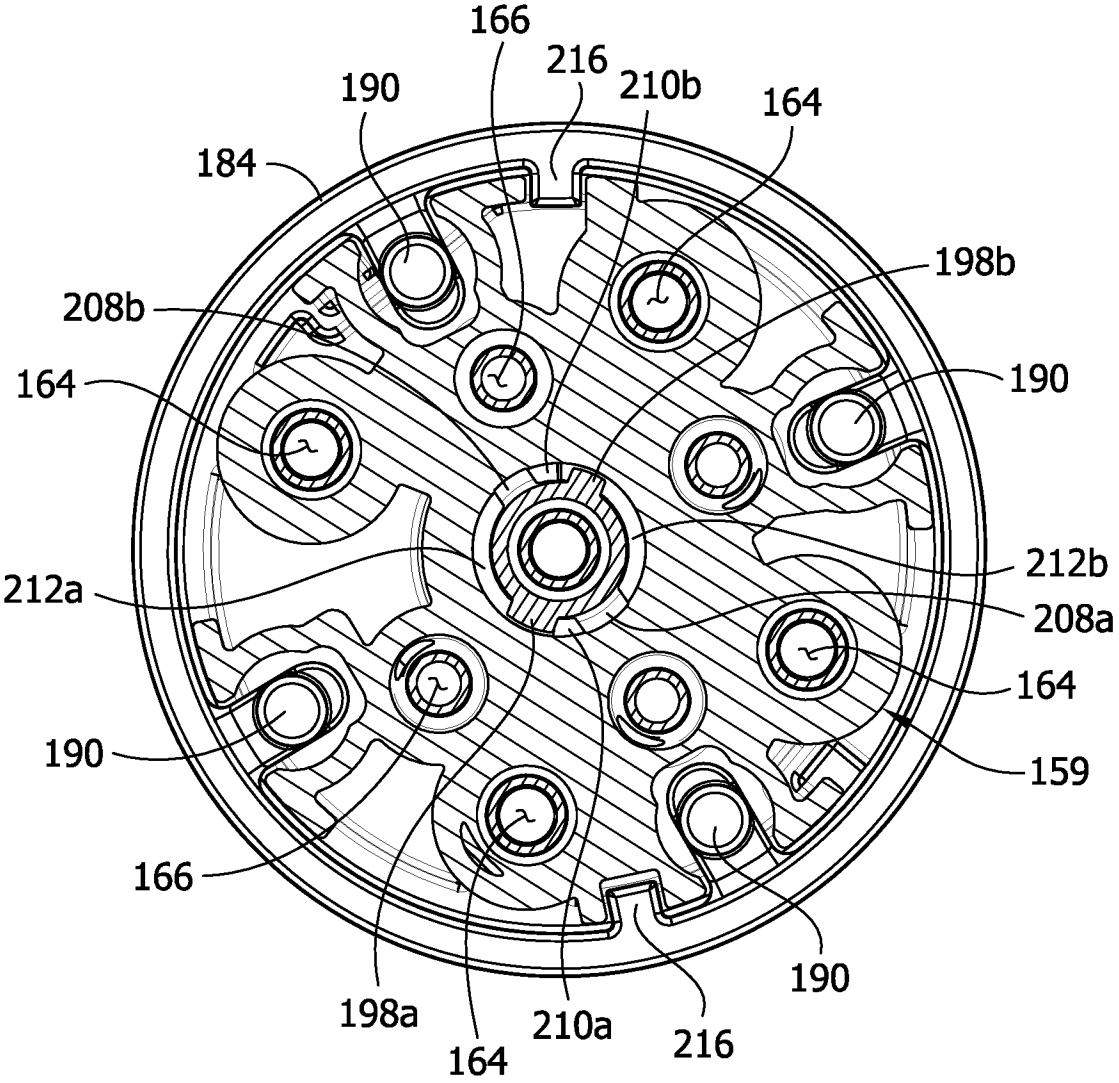
FIG. 14 is a cross section of the receptacle contact holder, showing the prongs of the safety disk locked in corresponding tracks of the holder body.

Referring to FIG. 13, to secure the safety disk 186 to the holder body 154, the first and second prongs 198*a*, 198*b* are inserted into the respective first and second grooves 208*a*, 208*b* of the central axial passage 164. Because the second groove 208*a* has a width less than the width of the first prong 198*a*, the first and second prongs 198*a*, 198*b* are keyed to the first and second grooves 208*a*, 208*b* to facilitate proper angular positioning of the safety disk 186 relative to the holder body 154 during assembly. After inserting the prongs 198*a*, 198*b*, the safety disk 186 is rotated (e.g., clockwise) so that the sloping side walls 202*a*, 202*b* of the prongs slide along sloping sides of the corresponding ramps 210*a*, 210*b*, and then pass over the corresponding ramps into angular clearance areas (i.e., first and second tracks 212*a*, 212*b*) between the first and second ramps, as shown in FIG. 14. The axial sides 200*a*, 200*b* of the first and second prongs 198*a*, 198*b* contact corresponding axial sides of the first and second ramps 210*a*, 210*b* when rotating the safety disk 186 toward the angular position in which the prongs were inserted into the corresponding grooves 208*a*, 208*b* to inhibit the prongs from reentering the corresponding grooves.

As shown in FIGS. 13 and 14, the safety disk 186 is rotatable relative to the holder body 154 about the axis from a closed angular position to an open angular position. In the closed angular position, the axial openings 196 in the face plate 192 are angular offset from the corresponding axial passages 164, 166 in the distal body portion 159 of the holder body 154. In this way, the face plate 192 covers, at least partially, the axial passages 164, 166 in the distal body portion 159. In the closed angular position (FIG. 13), alignment posts 216 on the compression ring 184 are received in corresponding alignment recesses 218 defined by the safety disk 186 (e.g., the face plate 192) to selectively retain the closed angular position. In the open angular position (FIG. 14), after the safety disk 186 is rotated (e.g., rotated 30-45 degrees from the closed angular position), the axial openings 196 in the face plate 192 are aligned with the corresponding axial passages 164, 166 in the distal body 159 portion of the holder body 154. In the illustrated embodiment, the plug 12 is first partially inserted axially into the mating segment 128 of the receptacle 14 and the plug contacts 30, 32 are inserted into the corresponding axial openings 196 in the face plate 192, such that the mating segment 28 of the plug moves the compression ring 184 relative to the holder body 154, the springs compress 182, and the alignment posts 216 withdraw from the corresponding alignment recesses 218 of the safety disk 186. After partially inserting the plug 12 and the plug contacts 30, 32, the plug is rotated about its axis PA to impart rotation of the safety disk 186 relative to the holder body 154 such that the axial openings 196 in the face plate 192 align with the axial passages 164, 166 in the holder body. With the axial openings 196 aligned with the corresponding axial passages 164, 166, the plug 12 and the plug contacts 30, 32 are moved axially relative to the receptacle 14 and the face plate 192 of the safety disk 186 to insert the plug contacts 30, 32 into the corresponding axial passages 64, 66 and in engagement with the receptacle contacts 130, 132. When fully connected, the latch 138 on the receptacle 14 connects to the plug housing 16 to selectively retain the connection of the plug 12 and receptacle 14.

Modifications and variations of the disclosed embodiments are possible without departing from the scope of the invention defined in the appended claims.

When introducing elements of the present invention or the embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A receptacle for an electrical connector comprising:

a receptacle housing having opposite distal and proximal ends and an axis extending between the distal and proximal ends, the distal end defining a receptacle opening through which a mateable plug is insertable;

a contact holder received in the housing and having distal and proximal ends and an axis extending between the distal and proximal ends, the contact holder including a holder body having opposite distal and proximal body portions, wherein the proximal body portion defines axial passages extending axially through the holder body and transverse alignment slots extending through a side of the proximal body portion, the alignment slots having axial openings;

a plurality of contacts supported by the contact holder, each contact including a wire terminal, a compressible pin extending distally outward from the wire terminal, and a terminal fastener extending transversely from the wire terminal, wherein the terminal fasteners are received in the alignment slots through the axial openings and retained in the transverse alignment slots.

2. The receptacle for an electrical connector set forth in claim 1, wherein the compressible pins extend within the axial passages at the distal body portion.

3. The receptacle for an electrical connector set forth in claim 2, wherein the wire terminals are received in the axial passages at the proximal body portion.

4. The receptacle for an electrical connector set forth in claim 3, wherein the contact holder includes a holder cap over the proximal body portion of the contact holder, wherein the holder cap has a proximal end defining wire openings aligned with respective axial passages of the proximal body portion, and a side defining transverse openings aligned with respective transverse alignment slots of the proximal body portion.

5. The receptacle for an electrical connector set forth in claim 4, further comprising a locking ring securing the holder cap to the receptacle housing.

6. The receptacle for an electrical connector set forth in claim 2, further comprising a safety disk secured to the holder body in opposing relationship with the distal end of the holder body, the safety disk defining a plurality of axial openings, wherein the safety disk is selectively rotatable relative to the housing and the holder body between an open position, in which the axial disk openings are aligned with respective axial passages of the holder body, and a closed position, in which the axial openings are misaligned with the axial passages and the safety disk covers the axial passages.

7. The receptacle for an electrical connector set forth in claim 6, further including compression springs received in spring holders defined by the distal body portion of the holder body, wherein the compression springs are compressible in a proximal direction when the plug is inserted into the receptacle through the receptacle opening.

8. The receptacle for an electrical connector set forth in claim 7, further comprising a compression ring distal of the compression springs and configured to engage and compress the compression springs when the plug is inserted into the receptacle through the receptacle opening.

9. The receptacle for an electrical connector set forth in claim 1, wherein the contact holder further includes an intermediate base plate having a disk shape, wherein the distal body portion extends distally from the intermediate base plate, and the proximal body portion extends proximally from the base.

10. A plug for an electrical connector comprising:

a housing having opposite distal and proximal ends and an axis extending between the distal and proximal ends, the proximal end being receivable in a receptacle to mateably connect the plug to the receptacle;

a contact holder received in the housing and having distal and proximal ends and an axis extending between the distal and proximal ends, the contact holder including a holder body defining axial passages extending axially through the holder body and transverse alignment slots extending through a side of the holder body, the alignment slots having axial openings;

a plurality of contacts received in respective axial passages, each contact including a wire terminal, a pin extending proximally outward from the wire terminal, and a terminal fastener extending transversely from the wire terminal, wherein the terminal fasteners are received in the alignment slots through the axial openings and retained in the transverse alignment slots.

11. The plug for an electrical connector set forth in claim 10, wherein the terminals of the contacts are received in the respective axial passages and the pins extend proximally outward from the axial passages.

12. The plug for an electrical connector set forth in claim 11, wherein the contact holder includes a holder cap over the holder body, wherein the holder cap has a distal end defining axial openings aligned with respective axial passages of the holder body, and a side defining transverse openings aligned with respective alignment slots of the holder body.

13. The plug for an electrical connector set forth in claim 12, further comprising a locking ring securing the holder cap to the housing.

14. The plug for an electrical connector set forth in claim 10, wherein the holder body includes a base having a disk shape, wherein the holder body extends proximally from the base.

15. A receptacle for an electrical connector comprising:

a housing having opposite distal and proximal ends and an axis extending between the distal and proximal ends, the distal end defining a receptacle opening through which a mateable plug is insertable;

a contact holder received in the housing and having distal and proximal ends and an axis extending between the distal and proximal ends, the contact holder including a holder body having a distal body portion, wherein the distal body portion defines a plurality of axial passages including a central axial passage, the distal body portion defining at least one groove extending along the central axial passage;

a safety disk rotatably secured to the holder body, the safety disk defining a plurality of axial openings, wherein the safety disk is selectively rotatable relative to the housing and the holder body between an open position, in which the axial disk openings are aligned with respective axial passages of the holder body, and a closed position, in which the axial disk openings are misaligned with the axial passages and the safety disk at least partially covers the axial passages, the safety disk including a hollow stem including at least one prong slidably inserted through the groove and captured within the central axial passage.

16. The receptacle for an electrical connector set forth in claim 15, wherein holder body defines at least one ramp adjacent the at least one groove, wherein the at least one ramp limits rotation of the safety disk in the central axial passage.

17. The receptacle for an electrical connector set forth in claim 16, wherein the at least one prong defines a sloping side wall.

18. The receptacle for an electrical connector set forth in claim 15, wherein the holder body defines at least one arcuate track along which the prong travels as the safety disk rotates relative to the holder body.

19. The receptacle for an electrical connector set forth in claim 15, wherein the at least one prong defines first and second prongs, wherein the first prong has a width greater than a width of the second prong.

20. The receptacle for an electrical connector set forth in claim 19, wherein the at least one groove includes first and second grooves, wherein the second groove has a width greater than the width of the second prong and less than the width of the first prong.

* * * * *